United States Patent [19]

Stima, III

[11] Patent Number: 4,846,466

[45] Date of Patent: Jul. 11, 1989

[54] MICROPROCESSOR CONTROLLED ELECTRO-HYDRAULIC EXERCISE SYSTEM

[76] Inventor: Michael W. Stima, III, 6195 Lakota Dr., Cincinnati, Ohio 45243

[21] Appl. No.: 123,136

[22] Filed: Nov. 20, 1987

[51] Int. Cl.[4] ..... A63B 21/24

[52] U.S. Cl. ..... 272/130; 272/129; 272/134; 272/DIG. 4; 272/DIG. 5; 272/DIG. 6

[58] Field of Search ..... 272/129, 130, 134, DIG. 4, 272/DIG. 6, DIG. 5

[56] References Cited

U.S. PATENT DOCUMENTS

| | | | |
|---|---|---|---|
| 3,395,698 | 8/1968 | Morehouse . | |
| 3,465,592 | 9/1969 | Perrine | 73/379 |
| 3,518,985 | 7/1970 | Quinton . | |
| 3,822,599 | 7/1974 | Brentham | 73/379 |
| 3,848,467 | 11/1974 | Flavell | 73/379 |
| 3,869,121 | 3/1975 | Flavell | 272/79 R |
| 3,902,480 | 9/1975 | Wilson | 128/25 R |
| 3,998,100 | 12/1976 | Pizatella et al. | 73/379 |
| 4,063,726 | 12/1977 | Wilson | 272/130 |
| 4,112,928 | 9/1978 | Putsch | 128/2.05 R |
| 4,235,437 | 11/1980 | Ruis et al. | 272/134 |
| 4,353,547 | 10/1982 | Jenkinson | 272/130 |
| 4,354,676 | 10/1982 | Ariel | 272/129 |
| 4,363,481 | 12/1982 | Erickson | 272/125 |
| 4,478,412 | 10/1984 | Muir | 272/130 |
| 4,491,016 | 1/1985 | Haefner | 73/30 |
| 4,493,485 | 1/1985 | Jones | 272/126 |
| 4,544,154 | 10/1985 | Ariel | 272/129 |
| 4,566,692 | 1/1986 | Brentham | 272/130 |
| 4,601,468 | 7/1986 | Bond et al. | 272/130 |
| 4,609,190 | 9/1986 | Brentham | 272/130 |
| 4,629,185 | 12/1986 | Amann | 272/130 |
| 4,786,051 | 11/1988 | Mullican | 272/134 |

OTHER PUBLICATIONS

Book, Wayne and Ruis, David "Microprocessor Controlled Robotic Exercise Machine for Athletics and Rehabilitation," Joint Automatic Control Conference, Denver, Colorado, Jun., 1979, pp. 771–776.

Book, Wayne J., "Control of a Robotic Exercise Machine," Joint Automatic Control Conference, Charlottesville, Virginia, Jun., 1981.

Stima, Michael W., III, "The State of the Art in Microprocessor Controlled Exercise Machines, Bionics has Arrived!", National Fitness Trade Journal, Fall 1986, pp. 20 & 45.

"Myotech: Automatic Exercise Comes to Fitness Equipment", National Fitness Trade Journal, 1987 Trade Show, p. 43.

Goldman, Robert M., D.O., "Sports Medicine Institutional Level Exercise Equipment," Journal of Osteopathic Sports Medicine, Jun., 1987, pp. 7–14.

*Primary Examiner*—Richard J. Apley
*Assistant Examiner*—Joe H. Cheng
*Attorney, Agent, or Firm*—Frost & Jacobs

[57] ABSTRACT

An exercise device is provided having a working arm structure which has its proximal end rotatably mounted to a frame. Exercise force is to be applied at the working arm's distal end to rotate the working arm during the positive stroke or resist the movement of the working arm during the negative stroke for each exercise repetition. An electro-hydraulic system provides a predetermined, substantially constant resistance to rotation of the working arm during such positive and negative strokes. This predetermined constant resistance is applied to the working arm at a fixed application point between the proximal and distal ends thereof, with the constant resistance being applied at the application point at an angle such that as the working arm is rotated, the angle changes to ensure the provision of a substantially proportional resistance to rotation of the working arm at the distal end. In a preferred embodiment, a microprocessor device determines the desired constant resistance to be applied to the working arm for any particular sequence of repetitions of the working arm. This microprocessor device calculates the constant resistance in response to the strength input data collected during an isometric contraction period in an initial minor portion of the first repetition of the sequence. In order to supply accommodating resistance in a preferred embodiment of the exercise device during periods of excessively accelerated rotation of the working arm, a simple hydraulic impedance can also be implemented into the electro-hydraulic system.

21 Claims, 7 Drawing Sheets

MICROPROCESSOR CONTROLLED ELECTRO-HYDRAULIC EXERCISE SYSTEM

BACKGROUND OF THE INVENTION

1. Field of the Invention:

The present invention relates generally to exercise devices and, more particularly, to a microprocessor controlled electro-hydraulic exercise system which automatically provides resistance according to individual user strength input.

2. Description of Related Art:

Various exercise devices have been developed over the past number of years which have raised the level of sophistication associated with lifting weights. Even so, the problem of selecting an appropriate weight for the individual user through guesswork or trial and error still remains, as does the associated inconvenience of having to manually select such weight through placement of selector pins, adjusting knobs and dials, or the like. Other exercise devices utilize various configurations of keypads, keyboards, or control panels.

Further, while accomodating resistance has been known in the art for some time, it has only been addressed by applying isokinetics, or constant velocity, through various mechanical, electrical, or hydraulic designs. Other common modes of resistance, such as isotonics (or constant force) have also been available. However, these modes of resistance have never been combined in order to take advantage of their desirable characteristics, and have only recently been provided as alternative modes of operation in a single exercise device.

U.S. Pat. No. 4,354,676, to Ariel, concerns an exercise machine having an exercise bar supported for rotation. This exercise bar acts against a hydraulic cylinder when it is rotated, with the angle of the bar and the pressure in the cylinder simultaneously measured during exercise. This data is fed to a microcomputer which indirectly controls the cylinder pressure through an adjustment in the position of a control valve in accordance with a selected exercise program. Additionally, the microcomputer provides outputs to displays which enable the person exercising to monitor his progress. The alleged improvement of the Ariel device over the prior art involved the measurement of force applied to the exercise bar and the angular displacement of the bar so that stored values for variables such as force, velocity, or acceleration can be compared with the measured values to develop a control signal for the hydraulic cylinder in order to ensure that the measured output values equal the desired values.

U.S. Pat. No. 4,544,154, to Ariel, is a continuation-in-part patent of the '676 patent, and relates to a passive programmable resistance device which utilizes a closed loop feedback system for controlling resistance to rotational or translational motion of an object. One or more actual parameters, such as force or position, are measured and compared with desired parameters, with the differences therebetween used to provide a control signal which controls the resistance to the movement of the object.

While the devices disclosed by the Ariel '676 and '154 patents recognize the need for regulating various parameters associated with lifting weights in order to provide what has become known in the industry as "accommodating resistance", or resistance conforming to user effort, these devices require a closed loop feedback to be implemented into the microcomputer software to maintain constant control parameters. This type of design is not only costly in terms of expense and microcomputer memory, but is complex in its application as well. Deviations from the constant control parameter must be detected by the software and then remedied by controlling a valve in order to provide compensating restriction to the flow of hydraulic fluid, thereby providing more or less resistance.

The other option which is provided in the Ariel devices is a mode of operation wherein a preprogrammed routine for force, velocity, or acceleration is utilized. This makes variable resistance available to the user pursuant to a known performance curve, even though it is not an accomodating resistance. Shortcomings of this mode of operation include the fact that the preprogrammed routine is either not specifically tailored to the user's needs, does not reflect the user's strength level at the time of exercise, or causes him to undergo the time consuming inconvenience of establishing a customized routine.

Thus, heretofore, there has not been provided in the industry an exercise device which automatically provides accomodating resistance at all phases of the exercise, including the determination of the appropriate amount of resistance at the beginning of the exercise, in a relatively simple and economical fashion.

DISCLOSURE OF THE INVENTION

It is an object of this invention to obviate the above-described problems.

It is another object of the present invention to provide an exercise device which automatically provides accommodating resistance during all phases of the exercise.

It is yet another object of the present invention to provide an exercise device which maintains a substantially constant resistance during repetitions which is independent of any force, velocity, or acceleration limiting controls.

It is still another object of the present invention to provide an exercise device which incorporates the feature of accomodating resistance in a relatively simple and cost effective manner while maintaining some tolerance for velocity and acceleration variance.

It is another object of the present invention to provide an exercise device built by parts standard in the industry.

It is yet another object of the present invention to automate the process of selecting resistance levels in exercise devices.

In accordance with one aspect of the present invention, an exercise device is provided having a working arm structure which has its proximal end rotatably mounted to a frame. Exercise force is to be applied at the working arm's distal end to rotate the working arm during the positive stroke or resist the movement of the working arm during the negative stroke for each exercise repetition. An electro-hydraulic system provides a predetermined, substantially constant resistance to rotation of the working arm during such positive and negative strokes. This predetermined constant resistance is applied to the working arm at a fixed application point between the proximal and distal ends thereof, with the constant resistance being applied at the application point at an angle such that as the working arm is rotated, the angle changes to ensure the provision of a substantially proportional resistance to rotation of the working arm at the distal end. In a preferred embodiment, a microprocessor device determines the desired constant resistance to be applied to the working arm for any particular sequence of repetitions of the working arm. This microprocessor device calculates the constant resistance in response to the strength input data collected during an isometric contraction period in an initial minor portion of the first repetition of the sequence. In order to supply accommodating resistance in a preferred embodiment of the exercise device during periods of excessively accelerated rotation of the working arm, a simple hydraulic impedance can also be implemented into the electro-hydraulic system.

BRIEF DESCRIPTION OF THE DRAWINGS

While the specification concludes with claims particularly pointing out and distinctly claiming the present invention, it is believed the same will be better understood from the following description taken in conjuction with the accompanying drawings in which:

DETAILED DESCRIPTION OF THE INVENTION

Figure 1:
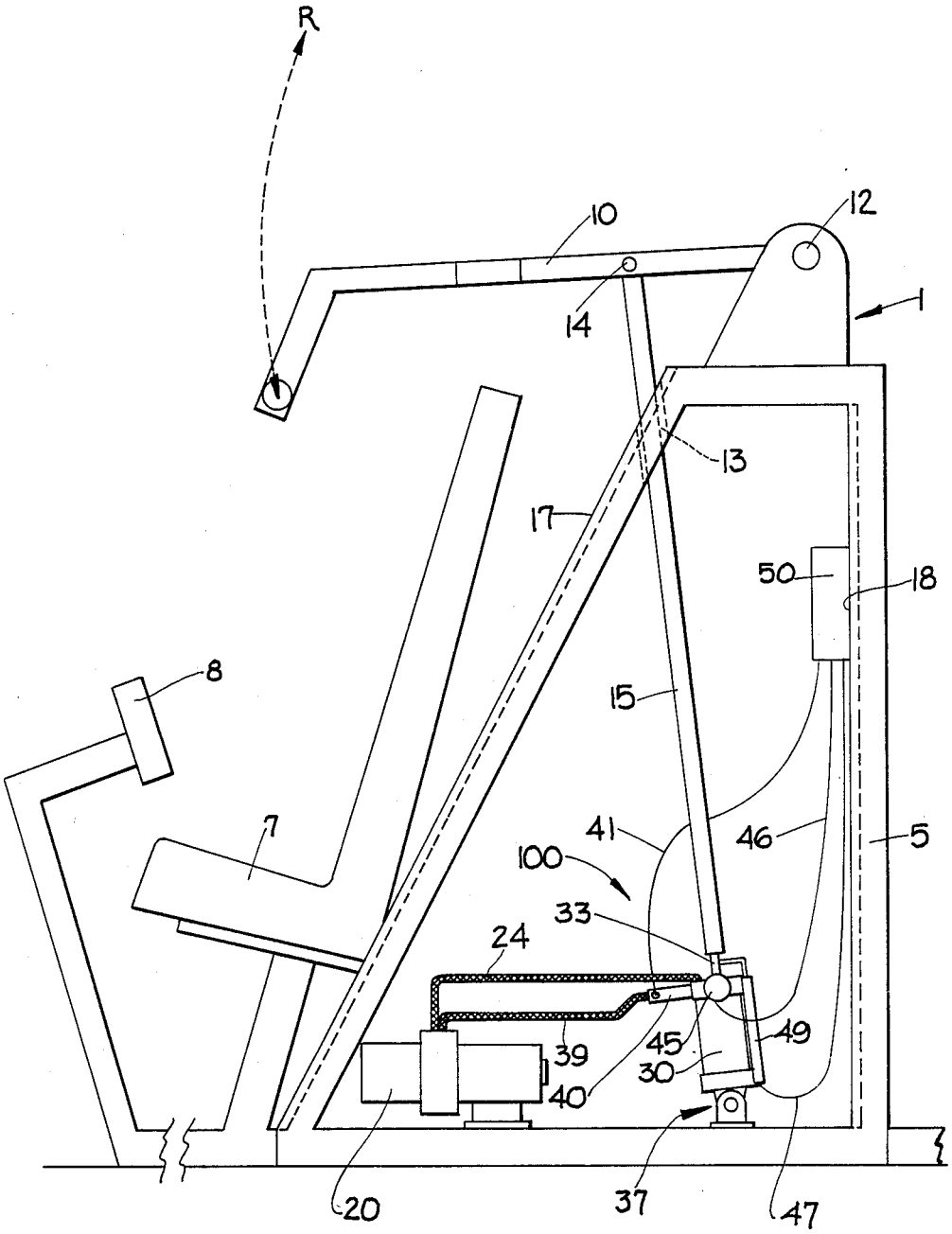
FIG. 1 is a side elevational view of an exemplary embodiment of the exercise system of the subject invention, shown, with the side panel removed so that the electro-hydraulic system components in the exercise system may be viewed.

Referring now to the drawings in detail, wherein like numerals indicate the same elements throughout the figures, there is illustrated a preferred embodiment of an exercise device of the present invention. Referring to FIG. 1, the exercise device 1 is shown generally with its side panel removed so that the components of electro-hydraulic system 100 may be viewed. Although the particular exercise device illustrated and described herein is for a shoulder press exercise (i.e., overhead or military press), the subject matter of the instant invention is equally applicable to any number of exercise devices. Frame structure 5 houses the elements of electro-hydraulic system 100 employed herein, as well as provides support structure for the entire exercise device, including chair 7 to be utilized by the user during exercise. Frame 5 further can provide support for display/control panel 8. Frame 5 also provides a degree of stability to the exercise device during use.

A working arm 10 is rotatably mounted at its proximal end to frame 5 at joint 12, such as by any number of commonly utilized mounting arrangements, such as a pin, rod, or axle mount. In use, the user will exert force upon the distal end of working arm 10, whereby working arm 10 tends to rotate about joint 12 in a manner corresponding to a desired range of movement required for the exercise to be performed on the device. This range of movement generally will be a non-linear pattern which conforms to known bodily movements for the muscles being exercised. For example, the overhead press exercise generally follows a slightly outward, then rearward path as illustrated by range path R in FIG. 1.

A tie-rod 15 is preferably rotatably attached to working arm 10 at point 14 by means of a pin, rod, or the like in order to permit the angle at which tie-rod 15 is attached to working arm 10 to change as working arm 10 is rotated about joint 12. The angular relationship at point 14 will be described in greater detail below. Basically, then, tie-rod 15 acts as a means for applying force provided by electro-hydraulic system 100 to working arm 10 which causes resistance to rotation of working arm 10. Of course, it will be understood by those skilled in the art that other devices, such as a chain and sprocket device, may be utilized in place of tie-rod 15.

In order to allow tie-rod 15 to interact with working arm 10, as well as to provide it some freedom of movement, an enlarged access opening 13 is formed in front panel 17 attached to frame 5. Opening 13 allows tie-rod 15 to move in accordance with the rotation of working arm 10 during the exercise without interference with frame 5.

Figure 2:
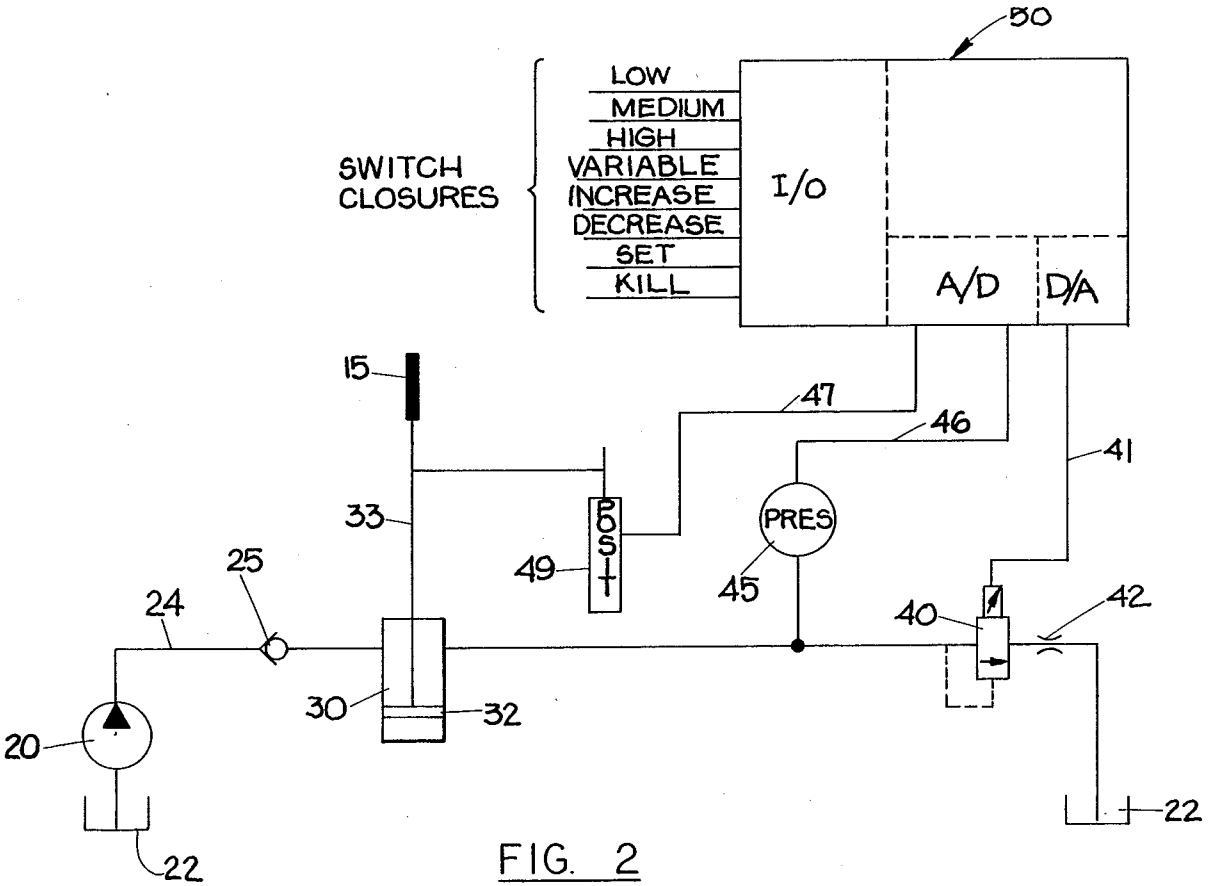
FIG. 2 is a schematic drawing depicting a preferred electro-hydraulic system of the exercise system of FIG. 1.

With respect to electro-hydraulic system 100 employed in exercise device 1, the components thereof may be viewed in FIG. 1 with their schematic representations being depicted in FIG. 2. It should be noted that electro-hydraulic system 100 is illustrated only as a preferred example of a means to provide predetermined, substantially constant resistance to rotation of working arm 10. Other similar devices, such as a pneumatic cylinder or electromagnetic power source could equally be substituted for the hydraulic system described herein. A hydraulic pump 20 is utilized to draw hydraulic fluid from a reservoir 22 contained therein toward a hydraulic cylinder 30 through supply conduit 24. In order to prevent backward flow of the hydraulic fluid, a check valve 25 is preferably positioned in supply conduit 24. A piston 32, as seen in FIG. 2, is mounted within hydraulic cylinder 30 for reciprocal movement in response to user applied force to piston 32 by means of a piston rod 33. Piston rod 33 is attached directly to tie-rod 15 so that piston 32 moves in direct response to rotation of working arm 10.

Hydraulic cylinder 30 is pivotably mounted to frame 5 by clevis mount 37, although other mounting devices may similarly be utilized. This allows hydraulic cylinder 30, which is attached to tie-rod 15 by means of piston rod 33, to pivot in conjunction with the rotation of working arm 10. The selection of the pivot point location is a critical feature of the present exercise device, because it allows the resistance force of hydraulic cylinder 30 to be geometrically adapted to working arm 10 so that a substantially proportional resistance is felt by the user at the distal end of working arm 10 during an exercise sequence.

Figure 4A:
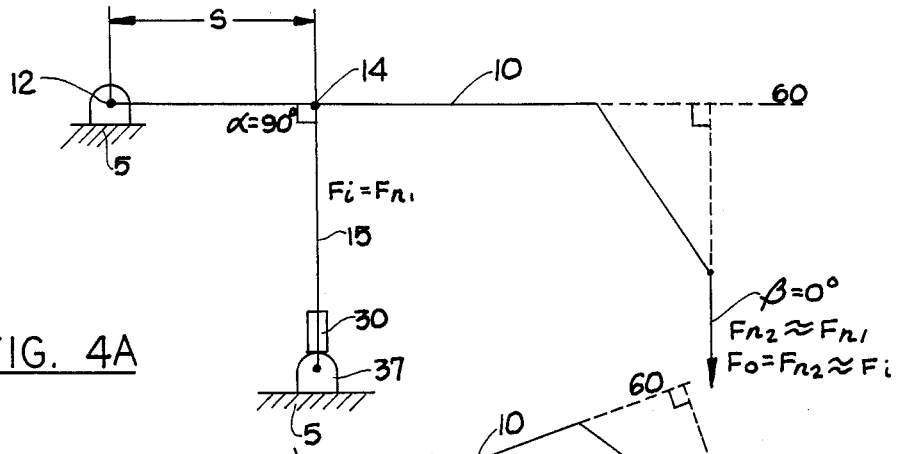
FIGS. 4A–4C are schematic diagrams depicting the geometric relationships between the working arm and the resistance system of an exercise system of FIG. 1.
Figure 4B:
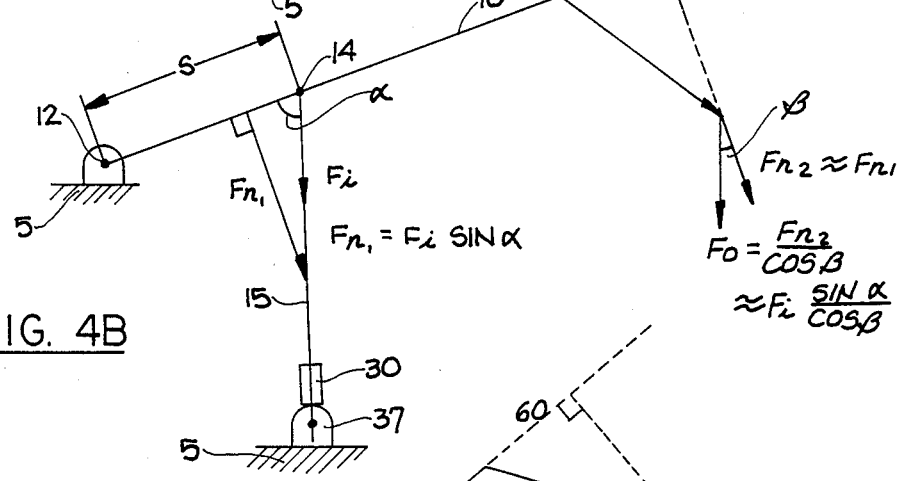
Figure 4C:
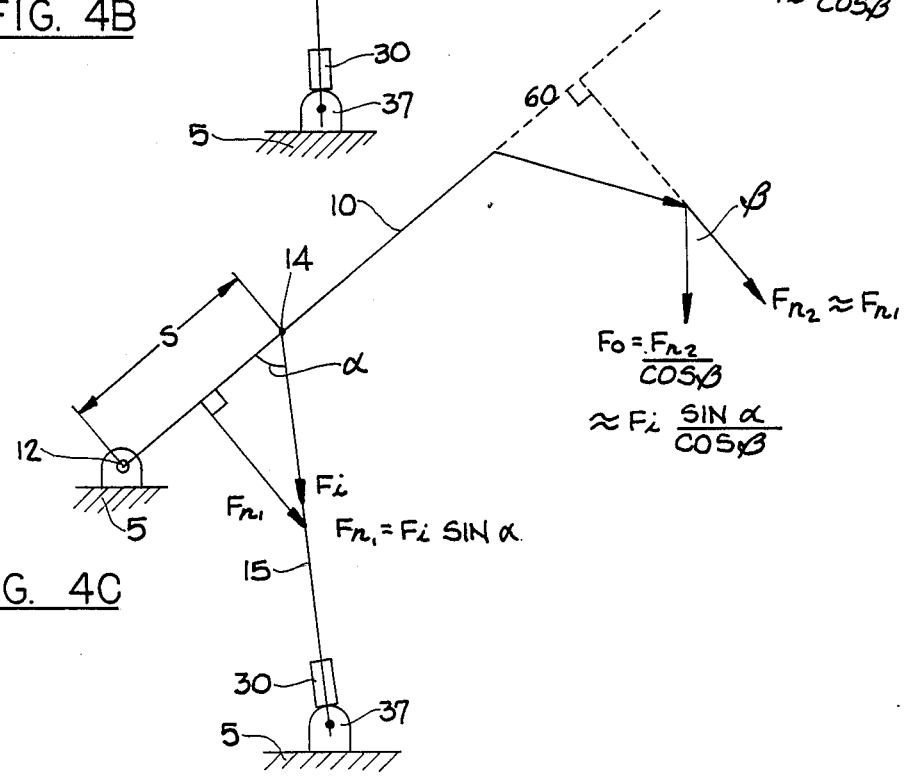

As depicted in FIGS. 4A–4C, working arm 10 is illustrated with its proximal end rotatably attached at joint 12 to frame 5. Tie-rod 15, as previously noted, is attached to working arm 10 at point 14 by means of a pin or other like pivoting arrangement, and supplies input resistance Fi provided by electro-hydraulic system 100 or, more specifically, by hydraulic cylinder 30. Distance S, which is defined as that distance from joint 12 to point 14, remains constant throughout rotation of working arm 10, as tie-rod 15 is immovably, albeit rotatably, attached to working arm 10 at point 14.

In order to provide an output resistance $F_o$ at the distal end of working arm 10 which is always maintained substantially proportional to input resistance $F_i$, the geometric arrangement is such that normal resistances $F_{n1}$ and $F_{n2}$ (which are perpendicular to the line of action 60 along working arm 10), shall remain substantially proportional and substituted into trigonometric equations to solve for output resistance $F_o$ for a given input resistance $F_i$ as follows:

$$F_{n1} = F_i \sin\alpha$$

$$F_{n2} = F_o \cos\beta$$

$$F_{n1} \approx F_{n2}$$

$$F_o \approx F_i \frac{\sin\alpha}{\cos\beta}$$

In such equations, angle $\alpha$ is that angle defined between tie-rod 15 and working arm 10, while angle $\beta$ is defined as that angle between normal resistance $F_{n2}$ and output resistance $F_o$. As illustrated, angles $\alpha$ and $\beta$ must be approximately 90° out of phase in order for output resistance $F_o$ to be substantially proportional to input resistance $F_i$.

As stated previously, during rotation of working arm 10, hydraulic cylinder 30 pivots relative tie-rod 15 and working arm 10. Thus, it can be seen in the various rotational positions depicted in FIGS. 4A–4C that as working arm 10 rotates, angle $\alpha$ changes inversely to angle $\beta$ to ensure that output resistance $F_o$ at the distal end of working arm 10 remains substantially proportional to a given input resistance $F_i$, in accordance with the equations set forth above.

It is noted, however, that the above trigonometric relationships are reliable only for a limited range of motion. Of course, these theoretical equations and the diagrams relating to the geometric configuration of exercise device 1 described above are intended only to describe generally the principles involved therein. Various design factors and structural limitations of practical significance, which are known to those skilled in the art, must be taken into account.

Attached at the exit outlet of hydraulic cylinder 30 is pressure control valve 40. It is contemplated that pressure control valve 40 will be utilized to proportionally control the pressure caused by movement of piston 32 and by flow from hydraulic pump 20 during an exercise repetition, thereby controlling the fixed amount of resistance provided against movement of piston 32 and, therefore, rotation of working arm 10. Attached to pressure control valve 40 is return conduit 39, which returns hydraulic fluid to reservoir 22.

An orifice 42 of restricted cross-sectional area is preferably placed in the outlet fitting of pressure control valve 40, although it may be placed at any point in return conduit 39 between pressure control valve 40 and reservoir 22. The predetermined effective diameter of orifice 42 provides additional resistance to movement of piston 32 since additional impedance to flow or back pressure develops when hydraulic fluid in excess of free flow conditions is being displaced. This non-free flow condition occurs when working arm 10 rotates at a rate of acceleration greater than a predetermined value (preferably somewhat less than the acceleration of gravity to minimize inertial effects of the mass of the system). Therefore, the resistance to rotation of working arm 10 is proportionally increased by any excess rate of acceleration during the exercise so as to discourage improper technique and provide accomodating resistance to the user. Additionally, ballistic effects of "throw the weight", which can minimize the reactive nature of the exercise and cause injuries, are addressed and deterred. The geometric relationship described above regarding tie-rod 15 and working arm 10 similarly ensures that the output resistance $F_o$ will remain substantially proportional to the input resistance $F_i$, which will be augmented by the additional impedance of orifice 42 during such non-free flow conditions.

In this exercise device, unlike those in the prior art, velocity and acceleration are not strictly controlled and increased acceleration is allowed to continue so long as the individual user can handle the additional resistance which is proportionally provided.

A single board computer 50 is preferably mounted on back wall 18 attached to frame 5 and has a lead 41 connected to pressure control valve 40 which communicates analog output information for operation of pressure control valve 40 in order to regulate the pressure caused by the hydraulic fluid flow from cylinder 30 as piston 32 moves and hydraulic fluid is delivered by hydraulic pump 20.

More specifically, pressure control valve 40 is of the proportional solenoid type which is commonly known (and therefore not shown in detail). In order to relieve pressure in pressure control valve 40, an opening in its outlet is provided, the opening and closing of which is controlled by the action of a poppet on a valve seat. Hydraulic pressure acts on the poppet about the seat diameter and is directly opposed by the electromagnetic force of an armature, this electromagnetic force being proportional to the current flowing through a coil integral with the valve body. The current to the coil is supplied by a digital-to-analog conversion section of computer 50. In order to keep the valve open during power failure, and thereby ensuring a safe and unpressurized hydraulic system, no springs are provided to act upon the poppet.

The analog input information is preferably generated through input from a pressure transducer 45 attached to hydraulic cylinder 30, which supplies pressure information to computer 50 through lead 46. The analog information is utilized only for establishing initial resistance set points in open loop fashion or for the purpose of data acquisition and recording. Also preferably provided is a position transducer 49 in conjunction with piston rod 33 for detection of movement by piston rod 33. A lead 47 allows information detected by position transducer 49 to be communicated to computer 50. As seen in FIG. 2, computer 50 includes an input/output port well know in the art, which receives information from switches having their closures located preferably on display/control device 8. These switches implement the various levels of workout (high, medium, and low), the mode of operation (variable or fixed set point), the "on-demand" controls (increase or decrease fixed pressure for the positive or negative resistances), the set switch for adjusting the upper and the lower limit of the range of movement, and the kill switch for ending the exercise. Each of these functions are described more fully below.

Figure 3A:
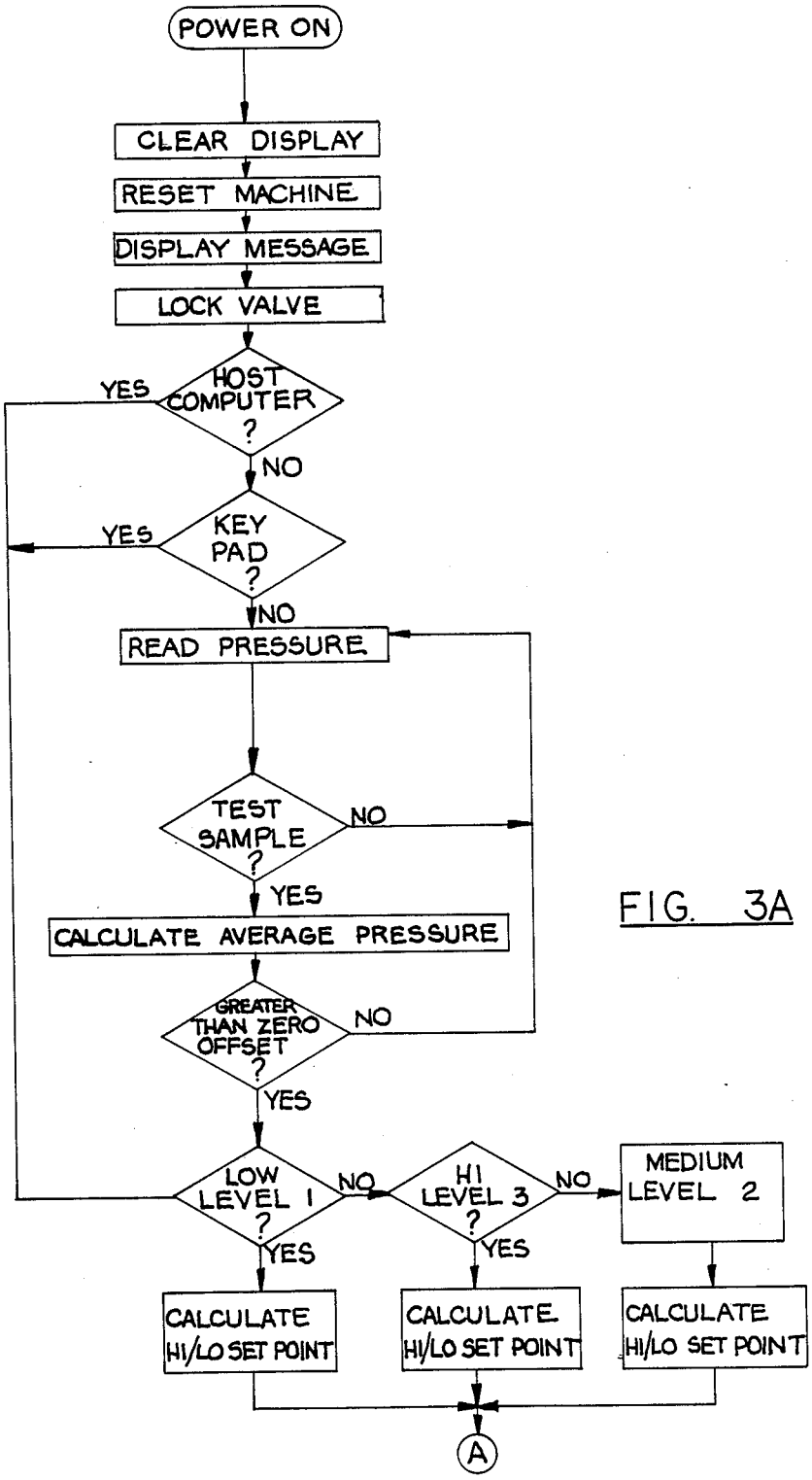
FIGS. 3A–3D are flow diagrams illustrating the preferred sequence of operation logic of an exercise system made in accordance herewith.
Figure 3B:
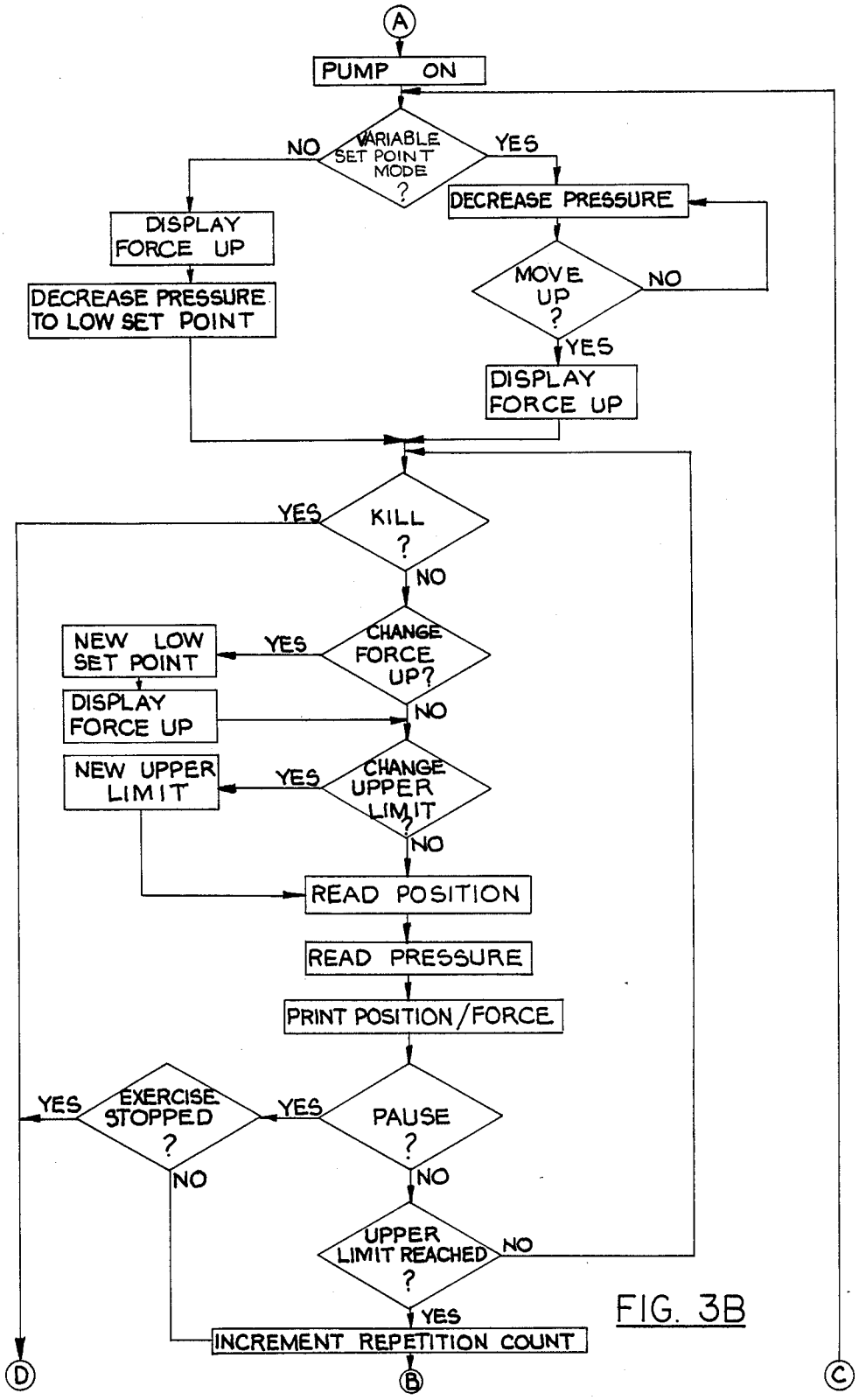
Figure 3C:
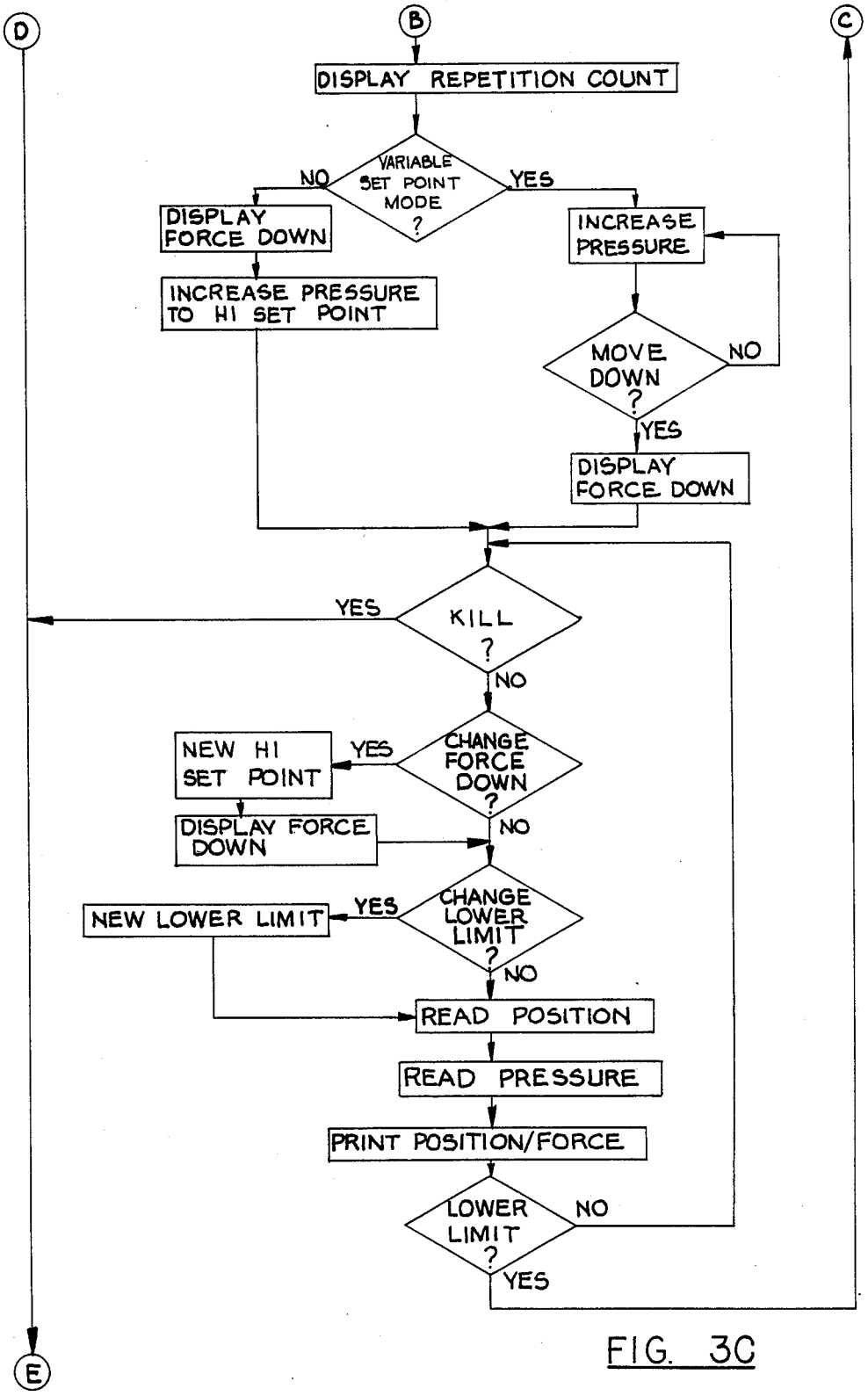
Figure 3D:
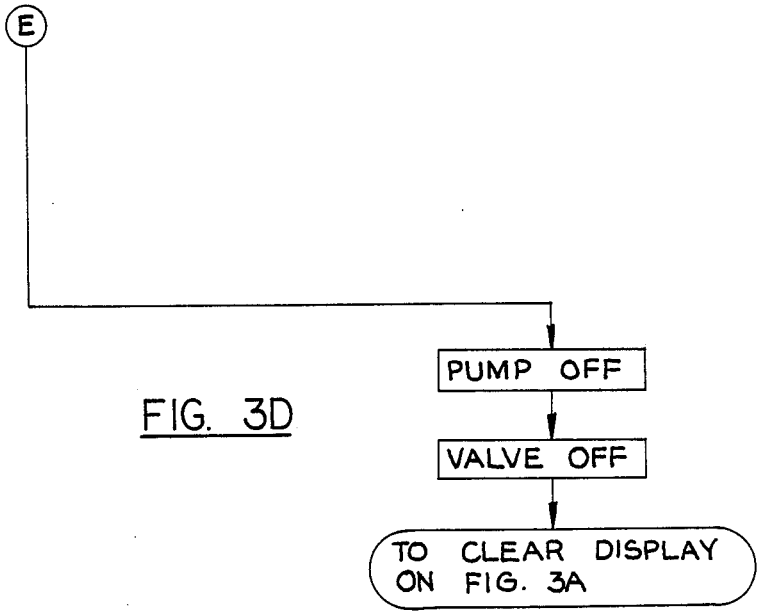

The elements, as described hereinabove, generally indicate the composition of the preferred electro-hydraulic system 100 utilized in exercise device 1 of the present invention. At this point, however, operation of the exercise device, as indicated by the flow diagram depicted in FIGS. 3A–3D, merits more in depth discussion. As seen in FIG. 3A, once power has been provided to exercise device 1, display/control panel 8 is cleared and the device reset. These steps are performed whenever exercise device 1 is first powered up or a new sequence of repetitions is enacted. Thereafter, a message is preferably scrolled across display/control panel 8 prompting the user to exert force on working arm 10 in order to start the sequence of repetitions. During this time, pressure control valve 40 is locked (i.e., preset at effectively maximum pressure), which in conjunction with check valve 25 ensures a period of isometric contraction during the initial period in which a user attempts to rotate working arm 10.

Before utilizing the strength input data received during the period of isometric contraction, computer 50 first determines whether the resistance set points have been received from an external host computer or a keypad. If they have, computer 50 skips down to the positive stroke loop described more fully below. Otherwise, once it has been determined that the resistance set points have not been input from either of these sources, pressure transducer 45 takes a number of pressure readings during the isometric contraction period to obtain a test sample, from which an average pressure is calculated. According to the speed of computer 50, these samples are preferably performed, and the pressure readings averaged and calculated, in approximately half a second or less. Thereafter, the computer determines whether this average pressure is high enough to overcome a zero offset built into the exercise device. This zero offset, which is an internal parameter determined for each device depending upon which exercise is being performed, is merely a minimum pressure level which acts as a guideline for when serious test samples are received.

Once the foregoing steps have been accomplished, computer 50 then determines which level of workout is desired by the user. As depicted in FIG. 3A, there are preferably three levels which are available to the user, although any number of levels may be programmed into computer 50. These levels signify which algorithm is to be applied to the data received in the test sample by computer 50 in order to calculate high and low set points of resistance for the sequence of repetitions. In this regard, as used herein, the "low set point" is the resistance force provided during the positive stroke of the repetition, which is when the muscle acts as a motor to lift or push the resistance. Correspondingly, as used herein, the "high set point" is the resistance provided during the negative stroke of the repetition, or when the muscle acts as a brake against the resistance returning to its initial position. Because the muscle can generate more force as a brake than as a motor, the negative resistance will generally always be greater than the positive resistance. The negative resistance is limited, however, to a level where an unsafe condition commonly referred to as the "mouse trap effect" is prevented.

Basically, the lowest level (i.e., level 1) is associated with an algorithm which, when applied to the pressure data accumulated in the test sample, calculates a positive resistance on the order of about 40% of the pressure value observed during the isometric contraction period, and a negative resistance level of approximately 60% of that value. This enables the user to perform a rather light workout or utilize the sequence of repetitions as a warm-up period.

The next level or second level (level 2) reflects a medium or normal workout, which is automatically implemented unless a different level is specifically chosen by the user, such as by manual input through buttons on display/control panel 8 (not shown). The level 2 workout has a positive resistance set point at approximately 60% of the pressure value observed during the isometric contraction period, and a negative resistance for approximately 80% thereof. Finally, the highest level (i.e., level 3) reflects the application of an algorithm which provides a positive resistance on the order of 80% of the observed pressure data, and a negative resistance of approximately 110% of that data. Therefore, by selecting the workout level at which the user desires to exercise, he is effectively choosing the relative degree of resistance provided during the positive and negative strokes of the repetitions. Of course, the percentages utilized for the various levels described above are exemplary and may be altered as desired.

It should also be pointed out that the exercise device of the subject invention is volitional in nature, meaning that it permits the user to retain some level of control over the calculated resistances, since it is his effort during the initial isometric contraction period of the first repetition, in conjunction with the level chosen, which results in the determination of the respective positive and negative resistances. Therefore, some degree of overlap between the various levels exists, since a user providing maximum effort at level 1 may end up with nearly the same positive and negative resistances as a user which exerts minimum effort at level 2. In this way, the exercise device is truly automatic based upon the individual user strength input.

After the high and low set points (negative and positive resistances, respectively) have been calculated, hydraulic pump 20 is activated and computer 50 determines whether or not the variable set point mode has been enacted. This is an optional mode of exercise that can be selected by the user, wherein the positive and negative resistances are separately determined for each individual stroke instead of fixed for the sequence of repetitions as in the normal mode. This variable set point mode will be discussed more fully hereinafter.

Assuming that the variable set point mode has not been selected, display/control panel 8 displays the force up (or the positive resistance) supplied by electro-hydraulic system 100 during the positive stroke. Afterward, computer 50 sends analog information in the form of a current to pressure control valve 40 in order to provide the desired pressure in electro-hydraulic system 100 conforming to the desired positive resistance. Since this will involve going from a situation where electro-hydraulic system 100 was at a maximum pressure during isometric contraction, the pressure will be gradually reduced in the system according to a predetermined ramp-down function.

At this point, the user may press a kill switch located on display/control panel 8 (not shown), which would erase the resistances calculated and take the user back to the display message. The procedure could then be recommenced by the user. Besides utilizing this switch to change calculated resistances by resetting the exercise device and requiring another test sample, it may also be utilized throughout the sequence of repetitions to stop the resistance being applied. This allows the exercise to be aborted at any given point and avoid any adverse effects to the user, since it effectively turns off hydraulic pump 20 and cuts off the signal to pressure control valve 40, thereby reducing the system's hydraulic pressure to zero.

Another feature of the exercise device is that the positive and negative forces may be changed during operation through use of what are called "on demand" controls. In particular, if an individual user begins a positive stroke and finds that the positive resistance is either too high or too low, he may adjust it through various convenient devices. In the preferred embodiment, these controls are in the form of buttons located on display/control panel 8 (not shown). Alternative devices might also include a pod or the like which is located conveniently to either the user's thumbs or other available limbs, whereby the positive force may be either incremented higher or decremented lower. If the "on demand" controls for this function are utilized, the modified positive resistance will preferably be shown on display/control panel 8.

Another available feature of the exercise device is the ability to change the upper limit of the range of movement of working arm 10 during the positive stroke, which also allows the user to customize his exercise. This feature may be appropriate for use when an individual user is rehabilitating injured muscles or concentrating on exercising a specific portion of a muscle and a limited range of movement is desired.

Once any desired modifications are made, computer 50 stores the various readings of position and pressure taken by position transducer 49 and pressure transducer 45 during the stroke so that the data may be printed out by an external computer which may be in communication with computer 50. These readings, however, specifically do not control electro-hydraulic system 100 in any way.

During the positive stroke performed by the user, readings are continually performed to determine whether completion of the stroke has been obtained. This is necessary in order to adjust the pressure in electro-hydraulic system 100 to provide the calculated negative resistance level for the negative stroke. In particular, in order for completion of the positive stroke to be fulfilled, one of two conditions must be satisfied. The first condition is the detection of a pause in movement of working arm 10 during the positive stroke. Generally, a pause indicates that the user has reached the end of a positive stroke (i.e. he cannot or does not wish to extend the motion). This is because the system assumes that a pause in movement will occur during the transition between the positive and negative stroke of the repetition. In order to detect the pause, a counting loop is preferably utilized in the computer to verify a true pause by observing a given number of increments, although a number of time measurement devices may be chosen. Of course, if the number of increments detected is less than a predetermined number, computer 50 assumes the user has stopped exercising and turns hydraulic pump 20 and pressure control valve 40 off for return to the initial position of exercise device 1.

The other condition which may indicate completion of the positive stroke is detection by position transducer 49 of the upper limit for the range of movement allowed for the exercise being performed. If neither of these conditions are satisfied, computer 50 will go back to a position just prior to the kill switch determination and perform the loop described until one of the two indicated conditions is met. Once this has happened, or the exercise device has determined the user has finished, the repetition count is incremented and displayed on display/control panel 8.

Once the positive stroke of the repetition has been completed, the negative stroke is begun. Before doing so, computer 50 once again determines whether the variable set point mode has been selected, and if it has not, displays the force down (or negative resistance) provided at the distal end of the working arm 10. It has been found through research that a user's muscle can exert more force as a brake than as a motor, so the negative resistance is generally greater than that provided during the positive stroke (as indicated by the calculation of the high and low set points). Therefore, electro-hydraulic system 100 (or other resistance means utilized) increases pressure therein so as to provide a negative resistance in conformity with the high set point calculated beforehand.

In order to minimize shock to the user's body, the transformation from positive resistance to negative resistance is preferably done in a gradual manner, as exemplified by a commonly known ramp-up function, wherein the slope of the ramp is an internal characteristic calculated for the particular exercise device being utilized. In this manner, the safety of the individual user and the device is enhanced.

In a manner parallel to that previously described for the positive stroke, computer 50 then runs through a negative stroke loop. Once again, computer 50 first determines whether or not the user wishes to kill, or abort, the repetition sequence. If the kill is not chosen, the user has the opportunity to alter the negative resistance provided by setting a new high set point through increasing or decreasing the weight increments as discussed in the positive stroke loop. Afterward, the new negative resistance is displayed and the user has the opportunity to change the lower limit of the range of movement in the exercise being performed in the way discussed previously for the upper limit.

Position transducer 49 and pressure transducer 45 continuously read the various values exhibited by electro-hydraulic system 100, and can make this data available to an external computer for printout.

Computer 50 then determines whether or not the lower limit of the range of motion for the exercise has been reached, which is the only condition that needs to be satisfied for completion of the negative stroke of the repetition. Computer 50 will continue the negative stroke loop until the lower limit has been reached, after which computer 50 will recognize the completion of the negative stroke and display and implement the force up. Then the positive resistance, or low set point, is entered and the pressure gradually reduced in electro-hydraulic system 100 by a ramp-down function.

This manner of alternating between positive and negative strokes will continue so long as the user does not push the kill switch to abort the exercise or discontinues exercising. Once either of these actions take place, though, hydraulic pump 20 and pressure control valve 40 are turned off and display/control panel 8 cleared so that exercise device 1 may be reset.

As noted hereinabove, another mode of operation besides that described for the fixed set points is the variable set point mode. When this mode is selected, the positive and negative resistances supplied by electro-hydraulic system 100 are calculated for each positive and negative stroke. With respect to the initial positive stroke, the preset pressure will be at a very high level, because pressure control valve 40 is preset at effectively infinite resistance during the initial isometric contraction period. Thus, computer 50 causes the pressure to be decremented until a predetermined positional change in the positive direction for working arm 10 is detected by position transducer 49, at which point the positive resistance is fixed for that particular positive stroke until completion. During this positive stroke, the positive resistance being supplied is displayed by display/control panel 8. The same positive resistance loop previously described herein is then utilized for detecting when the positive stroke has been completed.

After the positive stroke has been performed, the pressure in electro-hydraulic system 100 increases incrementally from that set during the positive stroke until some positional movement of working arm 10 is detected in the negative direction. At that time, the negative resistance is fixed for that particular negative stroke and displayed accordingly. Once again, the computer runs through a negative resistance loop like that previously described to determine when the negative stroke is completed. After this has been accomplished, calculation of the positive resistance for the following positive stroke is preset at the negative resistance for the prior negative stroke and then decremented until a positional change of the working arm is again detected. This sequence continues until either the kill switch has been pushed or the user has stopped exercising.

An additional feature of the present exercise device is a hydraulic impedance component that limits the rate of acceleration of the working arm to a predetermined maximum level. This is accomplished through an orifice 42 having a restricted cross-sectional area in return conduit 39 between pressure control valve 40 and reservoir 22, as identified previously herein. Orifice 42 limits the amount of hydraulic fluid which may flow through return conduit 39, thereby establishing back pressure in electro-hydraulic system 100 which generates resistance to movement of piston 32 (i.e., in addition to that provided by pressure control valve 40). Because the amount of this back pressure is directly proportional to the amount of hydraulic fluid attempting to flow through orifice 42 in excess of free flow conditions, this additional back pressure is directly related to over-acceleration of working arm 10. Orifice 42 is very simple and economical in design, and provides accommodating resistance to the individual using the exercise device. Therefore, even though substantially constant resistance is provided to rotation of working arm 10 under normal free flow conditions, this resistance may be increased when actions on the part of the user require it. Moreover, unlike other prior art devices, the velocity or acceleration of working arm 10 are not restricted in and of themselves. Instead, excesses in these areas are discouraged through additional resistance force being supplied by electro-hydraulic system 100.

While the exercise device has been described herein as for a shoulder press, it is contemplated that any exercise could be replicated. Having shown and described the preferred embodiment of the present invention, further adaptions of the exercise device can be accomplished by appropriate modification by one of ordinary skill in the art without departing from the scope of the present invention. Several alternatives and modifications have been described herein, and others will be apparent to those skilled in the art. Accordingly, the scope of the present invention should be considered in terms of the following claims and is understood not to be limited to the details of the methods and structures shown and described in the specification and drawings.

What is claimed is:

1. An electro-hydraulic exercise system, comprising:

(a) a frame;

(b) a working arm structure having a proximal end movably mounted to said frame and a distal end at which exercise force is applied to move said working arm during positive and negative strokes of an exercise repetition;

(c) means for providing substantially constant positive and negative resistances to movement of said working arm during the positive and negative strokes, said positive and negative resistance being applied to said working arm at a fixed application point;

(d) means for automatically determining the positive and negative resistances which respond to user strength input data collected during an isometric contraction period in the first positive stroke of said sequence of exercise repetitions, said positive and negative resistances being applied to said working arm for a sequence of positive and negative strokes of said working arm; and (e) means for transmitting said positive and negative resistances from said determining means to said providing means.

2. The exercise device of claim 1, wherein the distal end of said working arm is designed to move in a non-linear pattern during the sequence of positive and negative strokes in order to conform to a desired range of movement required for a particular exercise to be performed on said device.

3. The exercise device of claim 1, wherein said determining means further comprises:

(a) means for measuring pressure in said providing means during the isometric contraction period in said first positive stroke; and (b) a microprocessor device connected to said pressure measuring means, said microprocessor device performing an algorithm on pressure data received from the pressure measuring means, whereby said positive and negative resistances are determined for the positive and negative strokes of the sequence of exercise repetitions.

4. The exercise device of claim 3, wherein said microprocessor device can selectively apply one of a plurality of algorithms to determine said positive and negative resistances in accordance with a range command input selected prior to said first positive stroke.

5. The exercise device of claim 1, wherein said providing means further comprising:

(a) a hydraulic cylinder;

(b) a piston mounted in said hydraulic cylinder for reciprocating movement in response to hydraulic force applied to the piston;

(c) a reservoir of hydraulic fluid;

(d) a hydraulic pump, said pump directing the hydraulic fluid into said hydraulic cylinder from said reservoir;

(e) a control valve for proportionally controlling pressure caused by impedance of hydraulic fluid flow from said hydraulic cylinder as said piston moves, whereby a fixed amount of resistance against movement of the piston is provided, said control valve being operated by said determining means; and (f) means for providing additional impedance to flow of hydraulic fluid from said hydraulic cylinder when movement of said piston exceeds a predetermined rate of acceleration, said additional impedance means comprising an orifice of restricted cross-sectional area located in hydraulic conduit between said control valve and said hydraulic reservoir, whereby additional resistance against movement of the piston is formed from the impeded flow of hydraulic fluid to augment the fixed pressure of said control valve in proportion to the excess acceleration of the piston.

6. The exercise device of claim 5, further comprising means for monitoring start and end positions of the positive and negative strokes of each exercise repetition to enable appropriate implementation of the positive and negative resistances for the positive and negative strokes, said monitoring means being coupled to said microprocessor for relaying information thereto.

7. The exercise device of claim 6, said monitoring means comprising a position transducer to constantly monitor the relative position of said piston during movement of said working arm, said position data being sent to said microprocessor when upper and lower limits of each exercise repetition are detected.

8. The exercise device of claim 6, said monitoring means further comprising a timing mechanism to identify pauses in movement of said working arm during a positive stroke indicating completion thereof, whereby such data is sent to said microprocessor to indicate that the positive stroke has been completed.

9. The exercise device of claim 1, further comprising exercise modification command inputs which can be implemented by a user to customize said positive and negative resistances for the positive and negative strokes of a repetition during any particular positive or negative stroke.

10. An electro-hydraulic exercise system which automatically provides exercise resistance based upon individual user strength input, comprising:

(a) a frame;

(b) a working arm structure having a proximal end rotatably mounted to said frame and a distal end at which exercise force is applied to rotate said working arm during positive and negative strokes of an exercise repetition, said distal end being designed to move in a non-linear pattern during a positive and negative stroke sequence of exercise repetitions in order to conform to a desired range of movement required for an exercise to be performed on said device;

(c) means for providing substantially constant positive and negative resistances to rotation of said working arm, said positive and negative resistances being applied to said working arm at a fixed application point between said proximal and distal ends of said working arm at an angle which changes as said working arm is rotated, wherein resistances substantially proportional to said positive and negative resistances are provided during rotation of said working arm at said distal end;

(d) means for automatically determining the positive and negative resistances to be applied to said working arm for the positive and negative stroke sequence of exercise repetitions of said working arm, said determining means responding to user strength input data collected during an isometric contraction period in the first positive stroke of said sequence of exercise repetitions, said strength input data being utilized to calculate said positive and negative resistances for the positive and negative strokes of the sequence of exercise repetitions; and (e) means for providing at said fixed application point additional resistance to rotation of said working arm in the positive stroke when said working arm is accelerated at a rate greater than a predetermined value.

11. A method of automatically providing resistance is an electro-hydraulic exercise system based upon individual user strength input data, said method comprising:

(a) providing an exercise device with a working arm structure having a proximal end movably attached to a frame and a distal end at which exercise force is applied to move said working arm during positive and negative strokes of an exercise repetition;

(b) determining substantially constant positive and negative resistances to rotation of said working arm for said positive and negative strokes of said working arm, said positive and negative resistance determinations being made in response to user strength input data collected during an isometric contraction period in the first positive stroke of said sequence of exercise repetitions; and (c) providing said positive and negative resistances to rotation of said working arm during said positive and negative strokes.

12. The method of claim 11, said determining step including determination of said positive and negative resistances to rotation of said working arm, wherein said positive resistance is provided against rotation of said working arm during the positive stroke and said negative resistance is provided against rotation of said working arm during the negative stroke.

13. The method of claim 12, wherein said determining step is accomplished in less than one second.

14. The method of claim 11, further comprising the step of providing additional resistance against rotation of said working arm during the positive stroke when the rotation of said working arm is undergoing acceleration at a rate greater than a predetermined value.

15. The method of claim 12, wherein said positive and negative resistances may be manually adjusted during any particular positive and negative stroke.

16. The method of claim 12, further including the steps of constantly monitoring when the positive stroke is completed so said negative resistance is implemented for the negative stroke and when the negative stroke is completed so said positive resistance is implemented for the positive stroke.

17. The method of claim 16, wherein implementation of said positive and negative resistances is accomplished in a gradual manner so as to minimize drastic changes in resistance between strokes.

18. The method of claim 12, further including the step of selecting a variable set point mode wherein said position and negative resistances vary for each positive and negative stroke of said working arm.

19. The method of claim 18, wherein said step of selecting the variable set point mode includes initially setting said positive resistance at a high level and continually decrements until a predetermined amount of positional change of said working are is detected, said positive resistance thereafter being fixed for that particular positive stroke.

20. The method of claim 19, wherein said step of selecting the variable set point mode including initially setting said negative resistance at the fixed positive resistance and continually increments until a predetermined amount of positional change of said working arm is detected, said negative resistance thereafter being fixed for the particular negative stroke.

21. The method of claim 11, wherein said positive and negative resistances are provided at a fixed application point between the proximal and distal ends of said working arm, said positive and negative resistances being applied at an angle which causes as said working arm rotates, wherein resistances substantially proportional to said positive and negative resistances are provided during rotation of said working arm at said distal end.

* * * * *